United States Patent [19]

Nanthavong

[11] Patent Number: 5,029,545

[45] Date of Patent: Jul. 9, 1991

[54] OIL ELIMINATION DEVICE FOR A SEWING MACHINE

[75] Inventor: Phounsavath Nanthavong, Elgin, Ill.

[73] Assignee: Union Special Corporation, Chicago, Ill.

[21] Appl. No.: 446,947

[22] Filed: Dec. 6, 1989

[51] Int. Cl.[5] ..... D05B 71/00

[52] U.S. Cl. ..... 112/256; 112/43

[58] Field of Search ..... 112/43, 256; 184/6.15, 184/6.18; 277/201

[56] References Cited

U.S. PATENT DOCUMENTS

| | | | |
|---|---|---|---|
| 2,697,995 | 12/1954 | Nicolay | 112/256 |
| 3,773,003 | 11/1973 | Marforio | 112/256 |
| 4,079,685 | 3/1978 | Klundt | 112/256 |
| 4,419,948 | 12/1983 | Von Hagen | 112/256 |
| 4,545,312 | 10/1985 | Ingram | 112/256 |

FOREIGN PATENT DOCUMENTS

| | | | |
|---|---|---|---|
| 158411 | 1/1983 | German Democratic Rep. | 112/256 |
| 1202168 | 8/1970 | United Kingdom | 112/256 |
| 1346541 | 2/1974 | United Kingdom . | |

*Primary Examiner*—Werner H. Schroeder
*Assistant Examiner*—Paul C. Lewis
*Attorney, Agent, or Firm*—Morgan & Finnegan

[57] ABSTRACT

An oil elimination device for a sewing machine comprising, a needle bar, a needle bar bushing having a channel to receive the needle bar, a collector plate having a bore to receive the needle bar, and a recess adjacent to the bore. The device has a porous member received in the recess, with the porous member being in contact with the bushing and spaced from the needle bar, and a device for applying a vacuum to the porous member.

10 Claims, 1 Drawing Sheet

OIL ELIMINATION DEVICE FOR A SEWING MACHINE

BACKGROUND OF THE INVENTION

The present invention relates to an oil elimination device for a sewing machine.

In sewing machines oil is commonly presented to lubricate the needle bar and needle bar bushing. However, excess oil supplied in this manner tends to leak out at the bottom of the sewing machine onto the garment being sewn, and thus ruin the garment. It is of course advisable to eliminate this result.

SUMMARY OF THE INVENTION

A principle feature of the present invention is a provision of an oil elimination device for a sewing machine.

The oil elimination device of the present invention comprises, a needle bar, a needle bar bushing having a channel to receive the needle bar, a collector plate having a bore to receive the needle bar, and a recess adjacent to the bore. The device has a porous member received in the recess, with the porous member being in contact with the bushing and spaced from the needle bar, and means for applying a vacuum to the porous member.

A feature of the present invention is that any excess oil from the needle bar or bushing works onto the porous member.

Still another feature of the invention is that the porous member is spaced from the needle bar in order to prevent the porous member from causing oil leakage.

Yet another feature of the invention is that the vacuum applied to the porous member prevents saturation of the porous member.

A feature of the present invention is that the device collects oil and disposes the oil before the porous member becomes saturated.

Thus, a feature of the present invention is that the device prevents leakage of oil from the sewing machine onto a garment in order to prevent soilage of the garment.

Further features will become more fully apparent in the following description of the embodiments of this invention and from the appended claims.

DESCRIPTION PREFERRED EMBODIMENTS

Figure 1:
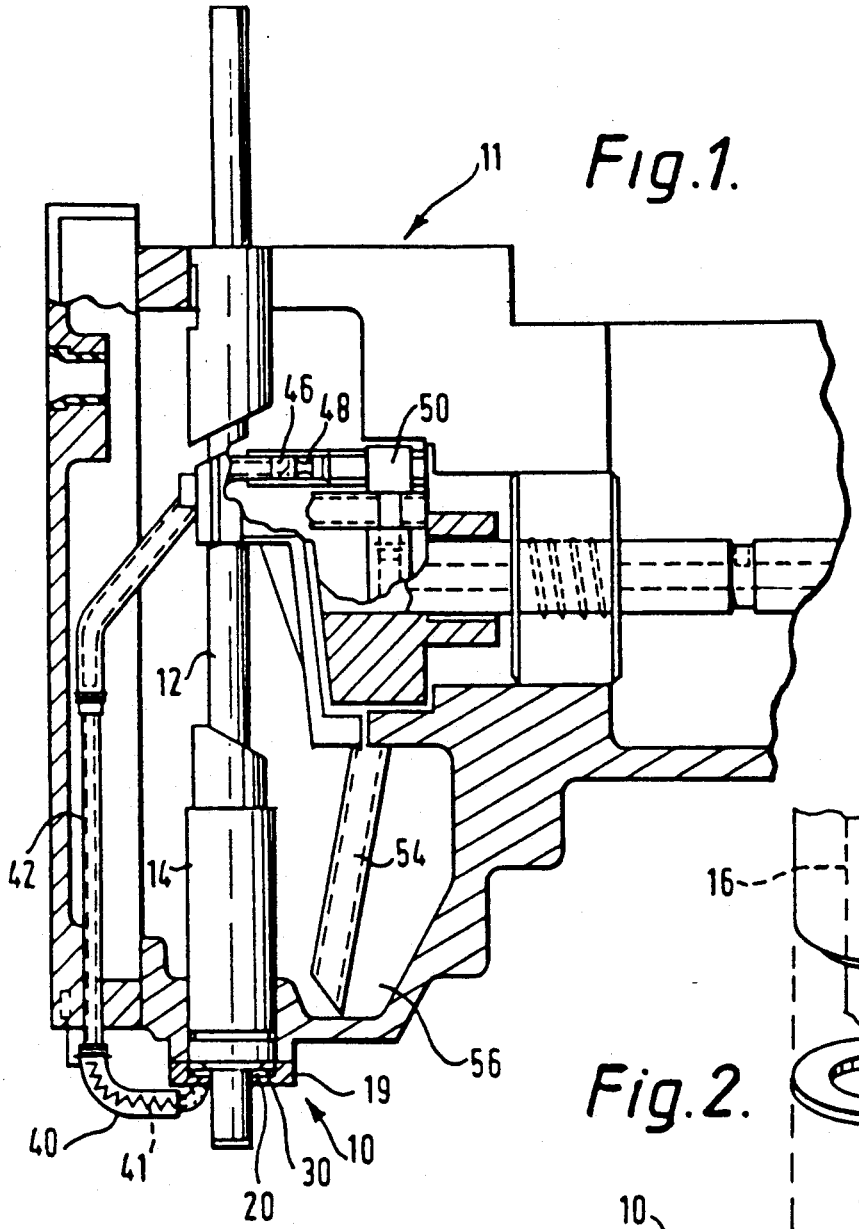
FIG. 1 is an elevational view, taken partly in section, of an oil elimination device of the present invention.
Figure 2:
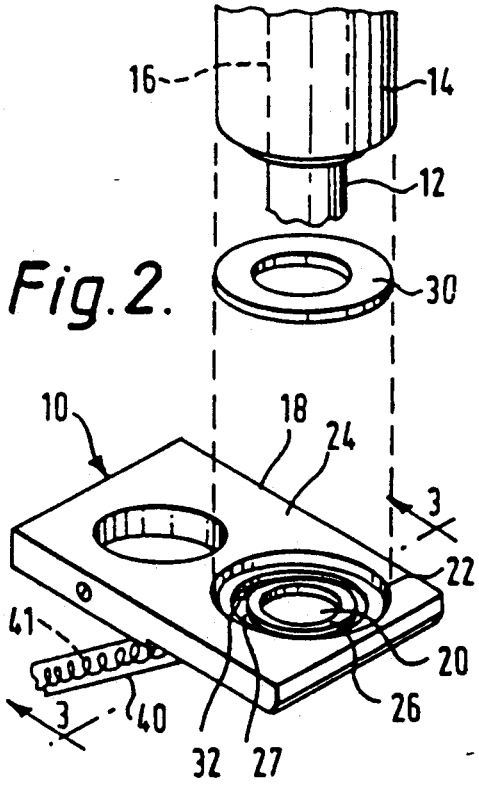
FIG. 2 is an fragmentarily exploded view of the oil elimination device of FIG. 1.
Figure 3:
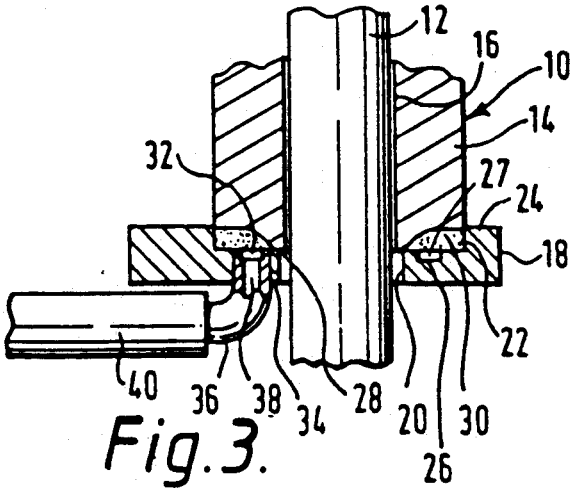
FIG. 3 is a fragmentary sectional view taken substantially as indicated along the line 3—3 FIG. 2.

Referring now to FIGS. 1–3, there is shown an oil elimination device generally designated 10 for a sewing machine 11 having an elongated cylindrical needle bar 12 which reciprocates in a vertical direction, a needle bar bushing 14 having a central bore 16 extending through the bushing 14 to receive the needle bar 12, and a collector plate 18 having a bore 20 to receive the needle bar 12.

The collector plate 18 has an annular recess 22 in an upper surface 24 of the collector plate 18, with the recess 22 extending around the bore 20 of the collector plate 18. As shown, the collector plate 18 has an upstanding annular rib 26 defining an annular groove 27 surrounding the bore 20, and the bushing 14 has a depending annular rim 28 which contacts the rib 26 when the bushing 14 is positioned on the collector plate 18. The oil elimination device 10 has an annular porous member 30, such as felt, porous filter paper or any other suitable porous material, that would wick up oil, with the annular member 30 being received in the recess 22 in a configuration with the bushing 14 contacting the annular member 30, and with the annular member 30 being spaced from the needle bar 12. In this manner, any oil from the needle bar 12 or bushing 14 wicks into the annular porous member 30, while the annular member 30 is not in direct contact with the needle bar 12 which otherwise might act as an "oiler" and cause oil leakage in the sewing machine.

The collector plate 18 has an opening 32 at the level of the groove 27 and communicating with the groove 27 and recess 22, and a channel 34 extending from the opening 32 through the collector plate 18. The oil elimination device 10 has a rigid tubular section 36 having a passageway 38 communicating with the channel 34. The tubular section 36 is connected to an elastic conduit 40 having a helical spring 41 inside the conduit 40 in order to prevent kinking of the conduit 40. The conduit 40 is connected to one or more oil return tubes 42 to an oil restrictor felt 46 and a restrictor 48 which is in turn connected to a T-Fitting 50. The T-Fitting 50 is connected to a suitable suction pump (not shown) to create a vacuum, and a depending tube 54 is also connected to the vacuum supplied by the pump. The restrictor 48 causes balance between the line with the tube 42 and the line with the tube 54 in order to balance flow from the two different lines and effect suction on both lines at the same time. During use of the sewing machine, oil is supplied to a chamber 56 surrounding the needle bar bushing 14. The pump which creates the vacuum removes the oil and supplies it into a sump.

In this manner, excess oil may wick from the needle bar 12 and needle bar bushing 14 into the porous annular member 30, and vacuum is supplied by the pump through the conduit 40 and channel 34 to the annular porous member 30 in order to prevent saturation of the annular porous member 30. The annular porous member 30 is in contact with the lower portion of the bushing 14 in order to wick oil into the porous member 30, while the porous member 30 is spaced from the needle bar 12 which might otherwise cause oil leakage from the sewing machine. In this manner, the device 10 prevents leakage of oil from the sewing machine onto a garment being sewn.

The foregoing detailed description is given for clearness of understanding only, and no unnecessary limitations should be understood therefrom, as modifications will be obvious to those skilled in the art.

What is claimed is:

1. An oil elimination device for a sewing machine, comprising:

a needle bar;

a needle bar bushing having a channel to receive the needle bar;

a collector plate having a bore to receive the needle bar, and a recess adjacent the bore;

a porous member received in the recess with the porous member in contact with the bushing and spaced from the needle bar; and means for applying suction to the porous member.

2. The device of claim 1 wherein the porous member comprises felt.

3. The device of claim 1 wherein the recess is annular and surrounds the bore of the plate, and in which the porous member is annular.

4. The device of claim 3 wherein the plate has an annular upstanding rib surrounding the bore, and in which the bushing has a depending annular rim in contact with the rib.

5. The device of claim 1, wherein the applying means comprises conduit means communicating with the recess, and means for connecting the suction to the conduit means.

6. The device of claim 5 wherein the conduit means comprises a channel extending through the plate and communicating with the recess, and a tubular section communicating with the channel.

7. The device of claim 1 wherein the plate has a groove in the recess.

8. The device of claim 1 wherein the recess is annular and surrounds the bore of the plate, and in which the plate has an annular groove in the recess.

9. An oil elimination device for a sewing machine, comprising:

an elongated reciprocating needle bar;

a needle bar bushing having a channel extending therethrough to receive the needle bar;

a collector plate having a bore to receive the needle bar, an annular recess surrounding the bore, and a channel communicating with the recess;

an annular felt member received in the recess, with the annular member being in contact with the bushing, and spaced from the needle bar; and means for applying suction to the channel of the plate.

10. The device of claim 9 wherein the plate has an annular groove in the recess communicating with the channel.

* * * * *